United States Patent [19]

Parrini et al.

[11] 4,186,037

[45] Jan. 29, 1980

[54] THERMAL TREATMENT OF INTERMEDIATE QUENCHING AND QUICK TEMPERING THROUGH EDDY CURRENTS AND A DEVICE FOR APPLYING SAID TREATMENT TO HIGH PRODUCTIVITY ROLLING PLANTS FOR FLAT PRODUCTS

[75] Inventors: Carlo Parrini, Taranto; Angelo Pozzi, Genoa, both of Italy

[73] Assignee: Italsider S.p.A., Italy

[21] Appl. No.: 718,969

[22] Filed: Aug. 30, 1976

[30] Foreign Application Priority Data

Sep. 12, 1975 [IT] Italy ..... 12790 A/75

[51] Int. Cl.[2] ..... C21D 1/10

[52] U.S. Cl. ..... 148/12.4

[58] Field of Search ..... 148/12 F, 12.4

[56] References Cited

U.S. PATENT DOCUMENTS

| | | | |
|---|---|---|---|
| 3,423,252 | 1/1969 | Grange | 148/12.4 |
| 3,506,468 | 4/1970 | Geipel et al. | 148/12.4 |
| 3,508,979 | 4/1970 | Mödder | 148/12.4 |
| 3,513,036 | 5/1970 | McFarland et al. | 148/12.4 |
| 3,539,404 | 11/1970 | De Retana | 148/12.4 |
| 3,666,452 | 5/1972 | Korchynsky et al. | 148/12.4 |
| 3,755,004 | 8/1973 | Miller | 148/12.4 |
| 3,756,870 | 9/1973 | Kasper et al. | 148/12.4 |

*Primary Examiner*—W. Stallard

*Attorney, Agent, or Firm*—Robert E. Burns; Emmanuel J. Lobato; Bruce L. Adams

[57] ABSTRACT

A method of thermally treating a rolled steel plate comprising receiving the rolled steel plate after it has been rolled to a final thickness, developing a uniformed temperature distribution within the rolled steel plate greater than a critical temperature of the steel plate, and quenching the steel plate while the temperature distribution thereof is still uniform and still exceeds the critical temperature. The critical temperature may be Arl or Acl.

12 Claims, 3 Drawing Figures

Rm (kgf/mm²)
Rs (kgf/mm²)
80
70
70
60
50
40
850°
800°
750°
DRQ
IQ1
NQ
IQ2 (600°-200°)
IQ1
AR
750°
850°
800°
NQ
IQ2(600°-400°)
AR
800
900
1000

CVNL+20 (kgfm/cm²)
IQ2(600°-400°)
AR
NQ
IQ1(850°-750°)
DRQ
IQ1 (850°-750°)
AR
DRQ
NQ
IQ2(600°-400°)
24
22
20
18
16
14
12
40
50
60
70
80
90
100
110
TT 35°C
800
900
1000°C

THERMAL TREATMENT OF INTERMEDIATE QUENCHING AND QUICK TEMPERING THROUGH EDDY CURRENTS AND A DEVICE FOR APPLYING SAID TREATMENT TO HIGH PRODUCTIVITY ROLLING PLANTS FOR FLAT PRODUCTS

BACKGROUND OF THE INVENTION

The production of high strength steel is performed at present through the following methods:

a—controlled rolling;

b—normalization;

c—conventional quenching and temper.

For the purpose of increasing the cost/quality ratio of the product, the method of controlled rolling, for a well defined range of thicknesses, is preferable as it permits the best balance between costs for the chemical composition, production times, and quality.

The normalization method has remarkable limits in productivity, in a thermal treatment cycle which is performed after rolling in a 'cold' sheet. In fact, as is well known, in the controlled rolling method the mechanical characteristics are obtained at the same time as the physical transformation through a thermomechanical treatment.

Even for compromise between cost, chemical composition, and mechanical properties, the normalized product is less advantageous than a product obtained through the controlled rolling method.

On the contrary, the quenching and tempering treatment obtains quality levels absolutely higher than those of both the controlled rolling and the normalization methods, and further for the same quality has a cost balance for the chemical composition/mechanical properties much more favourable than the other two methods.

However, in consequence of the double thermal cycle on a 'cold' sheet after the rolling and the quick cooling of the quenching step, the ratio (production cost/quality) is not competitive with the ratios deriving from the other two treatments, at least for quality levels corresponding to an ultimate tensile strength (UTS) greater than 60 kgs/mm$^2$ on thicknesses up to 50 mm for the controlled rolling and 100 mm for the normalization. For higher levels no recourse to other methods other than the quenching and temper one is known in the industry.

Recent studies of the Metallurgy Division of the British Iron and Steel Research Association and other laboratories have pointed out the possibility of obtaining, in particular types of steels, improvements in the strength and toughness by a quenching treatment performed right after the controlled rolling (direct quenching), with respect to natural cooling. The favourable effects remain even after tempering, so the characteristics are improved even with respect to the quenching and tempering method performed through a prolonged heating in austenization furnaces before the forced cooling.

That involves the performance of the quenching within the first seconds after the last passage of the controlled rolling, within a period of time such as to allow the temperature of the material to remain within in the austenitic range.

OBJECT OF THE INVENTION

The invention has for its object a thermal treatment of intermediate quenching and quick tempering by induction and a device for applying said treatment to high productivity rolling plants for flat products.

SUMMARY OF THE INVENTION

According to the invention, the quenching treatment is effected, independently of the interval of time between rolling and quenching, through a possible quick heating of the material in an induction furnace. The process according to the present invention comprises receiving a rolled steel plate after it has been rolled to a final thickness developing a uniform temperature distribution within the rolled steel plate greater than a critical temperature of the steel plate, and quenching the steel plate while the temperature distribution thereof is still uniform and still exceeds the critical temperature. The critical temperature may be Ar1 or Ar3. If, before quenching of the steel plate, it cools below the critical temperature the method according to the present invention further comprises heating the rolled steel plate to develop a uniform temperature distribution therein greater than the critical temperature. Heating is by fast induction heating, and after the heating the rolled steel plate is quenched down to an ambient temperature. It may be defined as 'intermediate quenching', and, the quenching treatment may be carried out in water with quenching machines like the Drever one or the like (e.g. by the method of a patent by C.S.M., Rome), starting from:

(1) Temperatures greater than Ar3, reached during the natural cooling after the hot rolling in times between 30 seconds and 10 minutes;

(2) temperatures comprised between the interval Ar3+Ar1, reached during the natural cooling after the hot rolling in times between 30 seconds and 25 minutes;

(3) temperatures greater than Ac1, reached through a quick induction heating starting from temperatures less than Ar1 obtained during the natural cooling after the hot rolling process in times greater than 30 seconds.

On the contrary, the quenching treatment after heating in a conventional furnace at temperatures not greater than Ac3 starting from room temperature is known, as well as the immediate direct quenching treatment from the temperature at the end of the rolling or from the temperature reached after natural cooling after the hot rolling process in times less than 30 seconds.

The main advantages of the invention are considered to be:

the decrease of the problems involved with the controlled rolling, technique resulting from the reduction of the limits of the rolling requirements to be met;

the total or partial exploitation of the rolling heat and the heat furnished in a quick heating cycle by an induction furnace;

the execution of tempering from temperatures Ar1 or Ac1.

BRIEF DESCRIPTION OF THE DRAWINGS

In order that the invention may be clearly undrstood, it will now be described, by way of example, with reference to the accompanying drawings, wherein.

DESCRIPTION OF THE PREFERRED EMBODIMENTS

EXAMPLE NO. 1 C—Mn steel

The steel, whose composition is shown in Table No. 1, was heated up to 1250° C., rolled to the thickness of 12 mm with end temperatures; the rolling being comprised in the interval 800°-1000° C.

Table No. 1

| C | Mn | Si | S | P | Al |
|---|---|---|---|---|---|
| .17 | 1.60 | .30 | .020 | .012 | .04 |

Table No. 2

| | Δ T Without heating or homogenization | | | | | Heated and homogenized at 900° C. | | | |
|---|---|---|---|---|---|---|---|---|---|
| Tfl | 50 | 100 | 150 | 200 | 250 | 300 | 400 | 500 | 600 |
| 800 | x | | | | | | | | |
| 900 | x | x | x | | | x | x | x | |
| 1000 | | x | x | x | x | | x | x | x |

Tfl = rolling end temperature
Δ T = decrease in temperature starting from the rolling end temperature, before subjecting the material to the method claimed.

The sheets obtained were cooled in the air for such periods of time as to obtain the ΔT shown in Table No. 2, then after the possible heating, quenched and afterwards tempered at 600° C., this temperature was kept for one hour.

Figure 1:
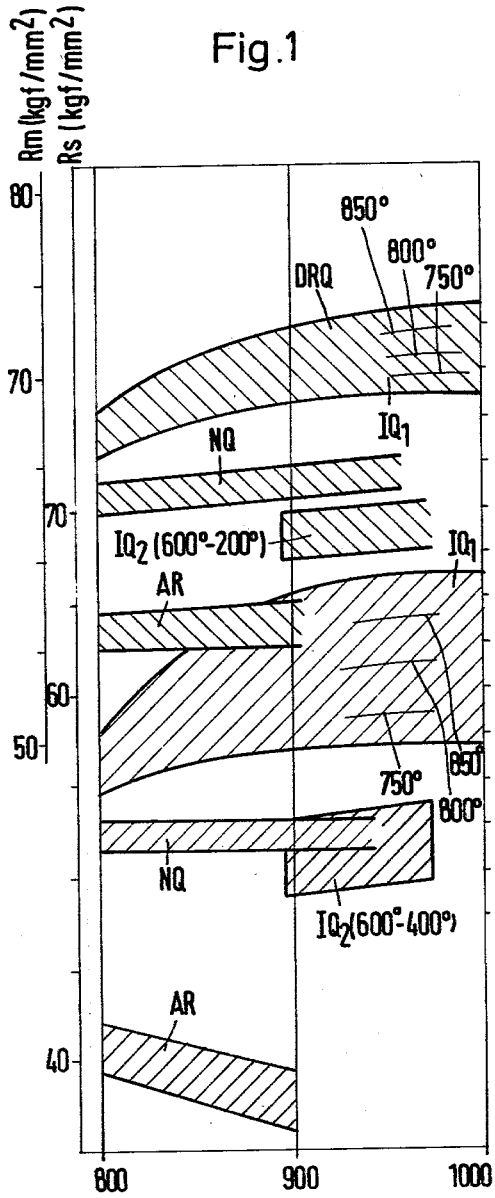
FIGS. 1, 2 and 3 show diagrammatically the mechanical characteristics of steels obtained by the method claimed, said characteristics being compared to those obtainable by the known methods.
Figure 2:
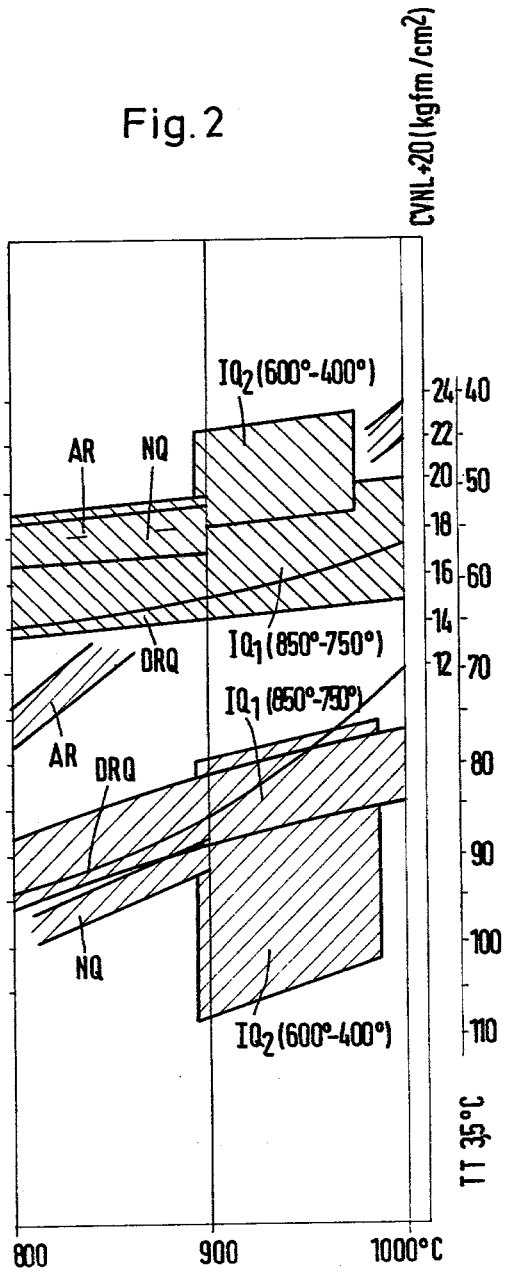

The results are shown in FIGS. 1 and 2, compared to those of the direct and classical quenching. FIG. 1 shows as ordinated the tensile strength Rm and the yield point on two separate scales, so as to render the diagrams clearer; and as abscissa the temperature of the rolling end. Further, the heavy shaded zones refer to the tensile stress Rm, while the light shaded ones to the yield points.

The other symbols denote respectively:

DQR: direct quenching, that is performed on the material coming out of the rolling plant without any intermediate heating, but within 30 seconds from the exit. That is a known method. $IQ_1$: intermediate quenching without heating, according to the invention.

$IQ_2$: intermediate quenching with heating, according to the invention.

NQ: normal quenching, that is with cooling in the air down to the room temperature and then heating in a furnace; this obviously is a known method.

AR: 'as rolled', that is without any treatment.

The temperatures shown in the shaded zones represent those of the rolling beginning for the $IQ_1$ treatment and those reached by the sheets after rolling for the $IQ_2$ treatment.

FIG. 2 shows as ordinates the resiliency (CVNL+20° C.) performed on a Charpy test element with a V-shaped intake, at 20° C., the diagrams concerning the resiliency are heavy-shaded; while the light-shaded diagrams refer to the transiction temperature concerning the level: 3.5 kgs/cm2.

EXAMPLE NO. 2 'Dispersoids' C—Mn steel

Figure 3:
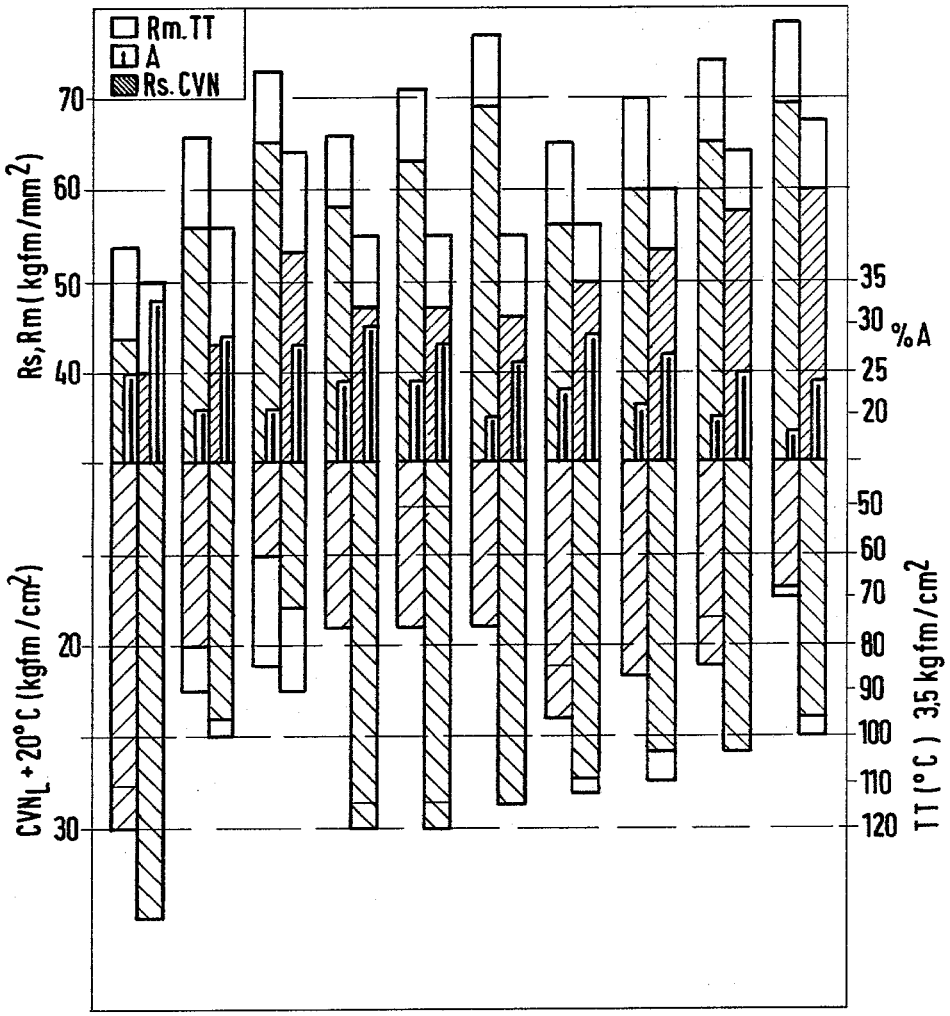

Various steels of this kind were considered. Their composition is shown in Table No. 3. After heating up to 1250° C. they were rolled to a 12 mm thickness with end rolling temperatures between 950° and 1000° C., then quenched in line from 900° C. and subject to a temper treatment at 600° C./one hour. FIG. 3 shows the results of their mechanical characteristics, compared to those of a burnt steel obtained through a classical quenching from 900° C.; with obviously the same composition.

Table No. 3

| | C | Mn | Si | Nb | V | N | Al |
|---|---|---|---|---|---|---|---|
| 1 | .07 | 1.2/1.3 | .25 | — | — | — | .030 |
| 2 | .15 | 1.2/1.3 | .30 | — | — | — | .030 |
| 3 | .17 | 1.6 | .30 | — | — | — | .030 |
| 4 | .07 | 1.2/1.3 | .30 | — | | — | .030 |
| 5 | .07 | 1.2/1.3 | .30 | .05 | — | — | .030 |
| 6 | .07 | 1.6 | .25 | .10 | — | — | .030 |
| 7 | .07 | 1.2/1.3 | .30 | .07 | .08 | — | .030 |
| 8 | .07 | 1.2/1.3 | .30 | — | .15 | — | .030 |
| 9 | .07 | 1.2/1.3 | .30 | — | .08 | .015 | .030 |
| 10 | .07 | 1.2/1.3 | .30 | — | .15 | .015 | .030 |

The same figure shows also, as comparison, the results of some tests on C—Mn steels.

The present invention considers also an improved treatment of temper to be performed after the quenching operation in water.

The invention comprises effecting the temper at less than Ac1 temperature on an even moving element through a quick heating in an induction furnace.

Therefore, as 'quick temper' is defined a heating and temperature keeping treatment performed wholly in 15 minutes, in competition with the conventional treatment comprising temperature keeping times, in addition to the heating times, of about 2 minutes for each mm of thickness.

The results are obtained at the end of two subsequent steps:

1. heating from room temperature until reaching the surface temper temperature in a section of the furnace operating through eddy currents in times less than 5 minutes;

2. temper temperature keeping for times less than 15 minutes, in a section of the furnace operating through the conventional method and with a length proportional to the permanence time as a function of the element thickness and translation speed.

By using this technique the following results were obtained:

EXAMPLE NO. 3

A 20 mm sheet of the steel of Table No. 4 was quenched from 920° C. after heating in a conventional furnace. The subsequent temper treatment was performed in both a two-section furnace according to the invention with a permanence time lower than 15 minutes, and a conventional furnace with a permanence time higher than 30 minutes. Table No. 5 shows the results of that comparison.

Table No. 4

| C | Mn | Si | S | P | Al |
|---|---|---|---|---|---|
| .12 | 1.15 | .30 | .009 | .027 | .040 |

Table No. 5

| | Rs (°) (kg/mm2) | R (°) (kg/mm2) | CVN MAX (kgm/cm2) | Transition temperature 50% Cr (°C.) |
|---|---|---|---|---|
| Normal temper (650° C.) | 46.7 | 56.3 | 28.4 | −110 |
| Quick temper | | | | |

Table No. 5-continued

| | Rs (°) (kg/mm2) | R (°) (kg/mm2) | CVN MAX (kgm/cm2) | Transition temperature 50% Cr (°C.) |
|---|---|---|---|---|
| (650° C.) | 46.6 | 57.9 | 28.7 | −85 |

(°) value on a test element obtained in longitudinal direction.

The method claimed is intended to be used on sheets with the following size:

| | | |
|---|---|---|
| - thickness | 8 | 50 mm |
| - width | 1000 | 4800 mm |
| - length | 5 | 50 meters |

according to two alternative cases.

CASE A is performed through a plant consisting of:

1. an induction furnace and a quenching machine positioned in line doanstream the hot fairing machine, at a distance from the finishing plant between 100 and 150 meters. Said induction furnace consists of multiple sections operating so as to assure a complete homogenization of the temperature on the whole sheet, and able of increasing the sheet temperature of 300° C. max. in a short time (<2 minutes)

2. a temper furnace of about 300 meters from the finishing plant and consisting of a first portion with induction multiple sections and of a second portion formed by a conventional furnace with a length between 80 and 150 meters.

The main feature of the present invention is the use of induction furnaces consisting of multiple sections of inductors passed through by the moving piece. The variable electromagnetic field originated by said inductors causes the sheet heating through the phenomenum of the eddy currents.

As for the flow of the material in production, five possible cycles are considered:

1. untreated material;
2. burnt material through the treatment exploiting the rolling heat;
3. only quenched material through the treatment exploting the rolling heat;
4. only tempered material;
5. material normalized through the use of a temper furnace.

1. Untreated material: it follows the normal cycle of rolling, fairing, hot shearing, plate cooling and finishing, by-passing the quenching step.

2. Burnt material: after the rolling, fairing and quenching steps it goes direct to the temper step and than to the shearing, cooling and finishing.

3. Only quenched material: it follows the same cycle as the burnt material until the quenching, then the same cycle as the untreated material.

4. Normalized or 'only tempered' material: it comes from the stock finishing and goes on to the temper or normalization step and the subsequent ones.

CASE B is embodied through a plant consisting of:

1. an induction furnace and a quenching machine positioned not in line and downstream the fairing machine and the hot shearing machine, connected to the roller course in line with the reversible through a transferring plate;

2. A temper furnace in line with the quenching machine, formed as in Case A;

3. a conventional heating and austenization furnace positioned upstream the quenching machine.

As for the flow of the material in production, six possible cycles are considered:

1. untreated material;
2. material burnt through the treatment exploiting the rolling heat;
3. material only quenched through the treatment exploiting the rolling heat;
4. tempered material;
5. normalized material;
6. material burnt after heating from room temperature.

1. Untreated material: it follows the normal cycle without involving the treatment line.

2. Burnt material (exploiting the rolling heat): it follows the cycle corresponding to Case A with interposed the steps of transfer from the reversible line to the treatment one, and to the finishing cycle.

3. Only quenched material: it comes from the conventional heating furnace and from the rolling ine and goes on to the quenching step and the finishing cycle.

4. Normalized or 'only tempered' material: it comes from the stock finishing and goes on to the temper or normalization step and the subsequent ones.

5. Material burnt after heated from room temperature: it comes from the conventional heating furnace and goes on to the quench, temper and subsequent steps.

It is to be understood that the invention is not limited to the examples shown. It is intended to cover all modifications and equivalents within the scope od the appended claims.

What we claim is:

1. A method of thermally treating a rolled steel plate, comprising:

receiving a rolled steel plate after it has been rolled to a final thickness;

developing a uniform temperature distribution within the rolled steel plate greater than a critical temperature of the steel plate; and quenching the steel plate while the temperature distribution thereof is still uniform and still exceeds the critical temperature.

2. A method of thermally treating a rolled steel plate according to claim 1, wherein said critical temperature is Ar1.

3. A method of thermally treating a rolled steel plate according to claim 1, wherein the step of developing a uniform temperature distribution includes heating the rolled steel plate to a uniform temperature exceeding the critical temperature.

4. A method of thermally treating a rolled steel plate according to claim 3, wherein heating the rolled steel plate includes electromagnetic inductive heating of the rolled steel plate.

5. A method of thermally treating a rolled steel plate according to claim 1, wherein said critical temperature is Ac1.

6. A method of thermally treating a rolled steel plate according to claim 1, wherein the step of developing the uniform temperature distribution comprises developing a uniform temperature less than Ac3.

7. A method of thermally treating a rolled steel plate according to claim 1, further comprising tempering the rolled steel plate after it has been quenched.

8. A method of thermally treating a rolled steel plate according to claim 1, comprising allowing the rolled steel plate to cool naturally down to a temperature higher than Ar3, developing the uniform temperature distribution without any net heating of the rolled steel plate, and quenching the rolled steel plate within 30 seconds to 10 minutes from the end of the rolling process.

9. A method of thermally treating a rolled steel plate according to claim 1, comprising allowing the rolled steel plate to cool naturally down to a temperature between Ar3 and Ar1, developing a uniform temperature distribution without any net heating of the rolled steel plate, and quenching the rolled steel plate within 30 seconds to 25 minutes from the end of the rolling process.

10. A method of thermally treating a rolled steel plate according to claim 1, comprising allowing the rolled steel plate to cool naturally down to a temperature lower than or equal to Ar1, heating the cooled rolled steel plate to a uniform temperature greater than Ar1, and quenching the rolled steel plate after more than 30 seconds from the end of the rolling process.

11. A method of thermally treating a rolled steel plate according to claim 10, wherein heating the cooled rolled steel plate is by rapid induction heating.

12. A method of thermally treating a rolled steel plate according to claim 10, comprising, after quenching the rolled steel plate to room temperature, tempering the rolled steel plate by: heating the rolled steel plate by induction to develop a surface temperature equal to the temperature at which tempering is to be carried out in less than five minutes; and then maintaining the rolled steel plate at the tempering temperature for less than 15 minutes in a convention furnace.

* * * * *